United States Patent [19]

Low et al.

[11] 3,988,594

[45] Oct. 26, 1976

[54] ELECTRIC FENCES

[76] Inventors: Kevin William Low, 461 Wellington Road, Marton; Robert Browne Wilkinson, 8 Saville Row, Johnsonville, both of New Zealand

[22] Filed: Dec. 17, 1974

[21] Appl. No.: 533,623

[30] Foreign Application Priority Data

Dec. 20, 1973 New Zealand ..... 172966

[52] U.S. Cl. ..... 307/132 R; 340/254; 323/60

[51] Int. Cl.[2] ..... H01H 47/00

[58] Field of Search..... 307/132 R, 132 TR, 132 V, 307/132 E, 132 EA, 132 M; 340/254; 256/10; 323/89 C, 60

[56] References Cited

UNITED STATES PATENTS

| | | | |
|---|---|---|---|
| 3,371,263 | 2/1968 | Walz et al. | 323/60 |
| 3,655,994 | 4/1972 | Malme | 307/132 R |
| 3,655,995 | 4/1972 | Malme | 256/10 |
| 3,683,269 | 8/1972 | Wanlass | 323/60 |
| 3,772,529 | 11/1973 | Boeing | 307/132 R |

*Primary Examiner*—Gene Z. Rubinson
*Assistant Examiner*—M. Ginsburg
*Attorney, Agent, or Firm*—Watson, Cole, Grindle & Watson

[57] ABSTRACT

An electric fence controller for controlling the charge on an electrified fence. A charging circuit is provided which includes a ferro-resonant input transformer. The transformer is provided with primary and secondary windings wound on separate legs of a saturable core. A capacitor is connected across the secondary winding and forms a resonant circuit with the secondary winding. An energy storing capacitive circuit is connected to the charging circuit. A voltage multiplying output circuit is connected to the capacitive circuit through a switching circuit. This arrangement enables the input to the transformer to be electrically isolated from the output circuit.

8 Claims, 4 Drawing Figures

ELECTRIC FENCES

This invention relates to improvements in electric fences and more particularly to an electric fence controller for an electric fence.

It is an object of the present invention to provide an electric fence controller which incorporates electrical circuitry enabling a substantially high voltage to be provided at the output terminals of the electric fence controller in an efficient manner.

Further objects of this invention will be apparent from the following description.

According to one aspect of this invention there is provided an electric fence controller comprising a charging circuit including an input transformer, an energy storing capacitive circuit connected to said charging circuit, a switching circuit connecting said capacitive circuit to a voltage multiplying output circuit, said input transformer being so adapted as to isolate said output circuit from an input connected to said input transformer.

Figures 1A, 1B:
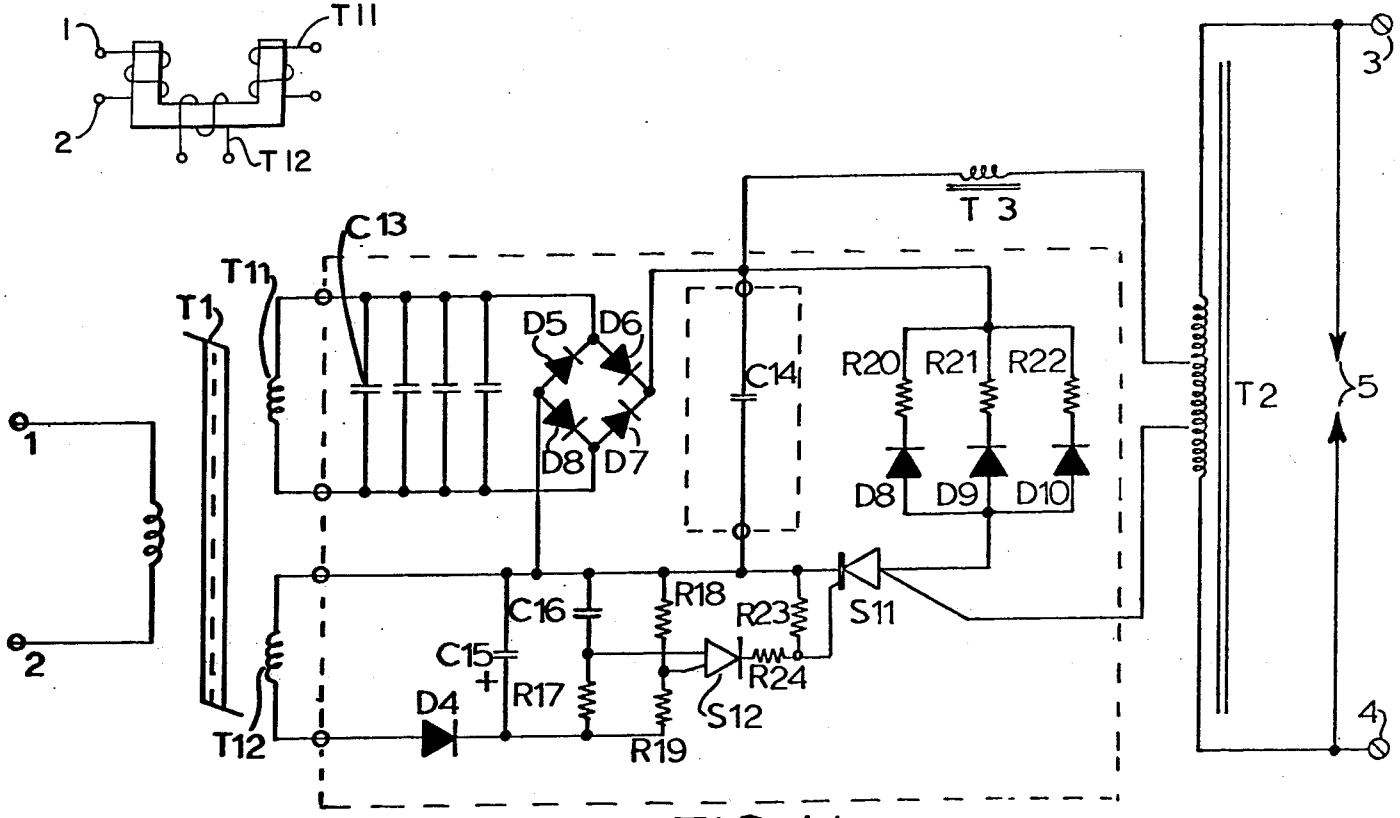

Further aspects of this invention which should be considered in all its novel aspects, will become apparent from the following description, given by way of example of a preferred embodiment of the invention, and in which reference is made to the accompanying drawings, wherein:

FIG. 1A: shows the electrical circuit for an electrical fence controller according to a preferred embodiment of the invention.

FIG. 1B: shows a C-core for use in the transformer of FIG. 1A.

Figure 2:
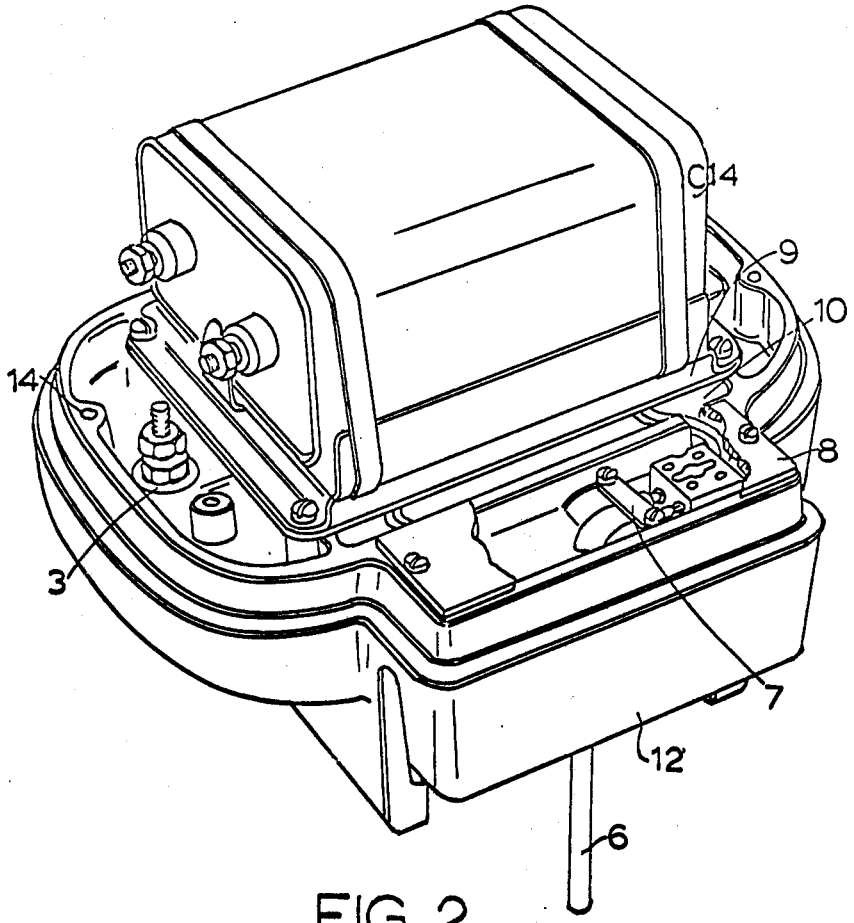

FIG. 2: shows a rear view of an electric fence controller with the cover removed according to one embodiment of the invention.

Figure 3:
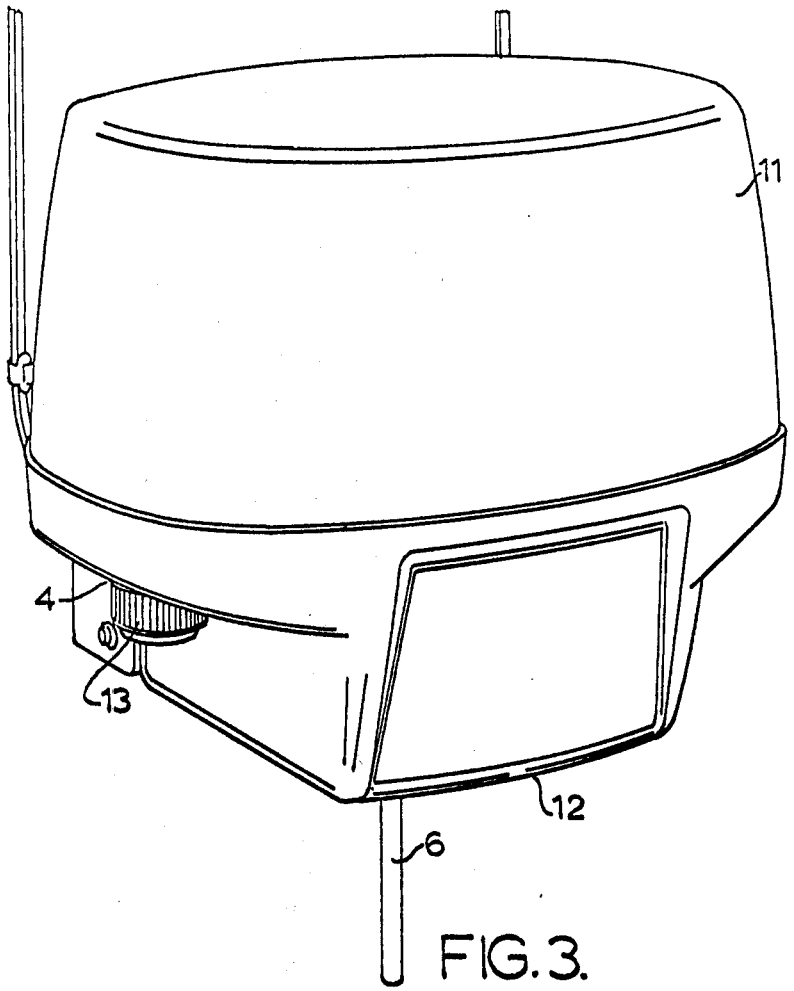

FIG. 3: shows a front view of the electric fence controller of FIG. 2 with the cover in place.

The present invention relates to an electric fence controller which provides a substantially high voltage for an electric fence which prevents the passage of animals therethrough and finds particular use in the control of grazing animals.

Regulations in respective countries, such as New Zealand standard specification 1525:1962, relate to such electric fence controllers, and particularly provide for the electrical isolation of the fence circuit from the input supply circuit, which isolation in electric fence controllers to the present time has been provided by the incorporation of suitable isolation between the windings of a step-up transformer connected to the output terminals of the controller.

However, it has been found that the provision of the electrical isolation in this matter provides a less positive electrical coupling between the controller circuit and the output terminals of the controller and thus it has proved difficult to provide good impedance characteristics for the controller. Further considerable disadvantages have arisen when the step-up transformer provided with such electrical isolation between its windings is connected to high current electronic switching devices. Also, in electric fence controllers, it is necessary to dissipate the heat generated by the electric circuitry thereof in an effective manner, and the relatively poor electrical coupling between the output terminals of the controller and the controller circuit caused by the electrical isolation provided in the step-up transformer has resulted in less efficient energy conversion characteristics for the controllers to the present time, with a consequent greaater heat generation which necessitates the provision of relatively complicated heat dissipation arrangements.

With respect to this heat dissipation, it is of course necessary to, while allowing for the dissipation of heat, prevent the entry of moisture within the controller, which prevention is proved more difficult when a greater amount of heat is required to be dissipated from the controller.

The present invention provides for the electrical isolation between the fence circuit and the input supply, to be provided by means of a suitable input transformer, the present invention thereby providing a much more positive electrical coupling between the controller circuit and the output terminals of the controller and hence the fence circuit, while also conforming to the regulations pertaining to such electrical fence controllers.

The electrical circuitry of an electric fence controller according to a preferred embodiment of the invention will now be described with reference to FIG. 1A of the accompanying drawings. In FIG. 1A, a suitable A.C. supply is connected across terminals 1 and 2 of the primary winding of a transformer T1. The transformer T1 is a constant voltage, current limited, ferro-resonant transformer, the primary and secondary windings of which are wound on separate legs of the saturable core of the transformer which core preferably being of the C-core type. The provision of the primary and secondary windings being wound on separate legs provides the required electrical isolation between the input supply and the fence circuit connected to the output of the fence controller, which isolation may be of the order of 10,000 volts, as required by New Zealand standard specification 1525:1962.

Across the main secondary winding T11 of the transformer T1 one or more capacitors C13 are connected, in parallel therewith so as to provide a resonant circuit with the transformer secondary winding T11. In FIG. 1A, four capacitors are shown connected in parallel across the secondary winding T11 of the transformer T1 so as to provide the aforementioned resonant circuit, although of course, one or more capacitors C13 of suitable value could be used.

A diode rectifier bridge D5, D6, D7, D8, is shown connected across the capacitors C13 which bridge circuit charges an energy storage capacitor C14 to a suitable voltage, for example 900 volts.

If any short circuit occurs in the resonant circuit of C13 and T11, the secondary voltage thereacross drops to zero while only a relatively small current of, for example 30mA, then flows through the secondary. Also, if any open circuit occurs in this resonant circuit then the ferro-resonance of the transformer T1 is not sustained and the secondary voltage is thereby reduced.

The energy storage capacitor C14 is shown connected in series with a thyristor S11 to part of the winding of an auto transformer T2, a series connected saturable inductor T3 also being shown connected in this series circuit. The inductor T3 provides an increase in the pulse rise time as the capacitor C14 discharges, upon the firing of the thyristor S11, into the winding of the auto transformer T2, thus providing for radio interference suppression.

The saturation of the inductor T3 which is in series with the winding of the auto transformer T2 controls the pulse overshoot which arises with reactive loads and this reduced pulse overshoot allows a greater voltage to be present at the controller output terminals while still conforming with regulations such as New Zealand standard specification 1525:1962 relating to the safety of fence controllers and also ensures that the switching circuit of the controller is given optimum protection under low impedance loads thus ensuring maximum life from the switching circuit components.

It is however envisaged that the saturable inductor T3 could be replaced by a suitable magnetic shunt circuit provided for the auto transformer T2.

The firing of the thyristor S11 is controlled by means of a triggering circuit including a programmable uni-junction transistor S12 which is provided with its operating voltage by means of a voltage developed across an auxiliary winding T12 of the transformer T1, a half wave rectifier diode D4 and smoothing capacitor C15 providing a suitable voltage therefor, of, for example 15 volts.

The timing period of the uni-junction transistor triggering circuit is controlled by means of capacitor C16 and resistor R17 connected thereacross, and also by the potential at the junction of resistors R18 and R19. A resistor R24 is also provided, which resistor limits the anode current of the uni-junction transistor S12, while a resistor R23 provides a low external impedance between the cathode and gate of thyristor S11.

The uni-junction transistor triggering circuit, as aforedescribed, provides a required pulse frequency of, for example one pulse per second, which fires the thyristor S11 to enable the discharge of the capacitor C14 through the winding of the auto transformer T2, the circuit of FIG. 1A providing for a substantially square pulse wave form across the output terminals 3 and 4 of the auto transformer T2. An advantage of the triggering circuit shown in FIG. 1 is that if any component thereof short circuits or open circuits the triggering circuit automatically ceases to operate.

Resistor-diode combinations R20, D8; R21, D9; and R22, D10, are shown connected across the capacitor C14 so as to substantially prevent back swing of the voltage pulse under no load conditions.

A spark gap indicated generally by reference numeral 5 is shown connected across the output terminals 3 and 4 of the controller which spark gap 5 together with the saturable inductor T3 clips any incident surge waves and thus reduces risk of damage by lightning strikes or the like in known manner. The voltage pulse across the part of the windings of the auto transformer T2 as the capacitor C14 discharges, provides for a required high voltage to be provided across the output terminals 3 and 4 of the controller, which voltage, being of the order of, for example 4,400 volts.

An advantage of the controller of the present invention is that the provision of a ferro-resonant input transformer T1 having a saturable core, the voltage output from the capacitor C14 is relatively independent of the input supply, the transformer secondary winding T11 providing a substantially constant voltage for the charging circuit.

Also, the positive coupling provided between the charging capacitor C14 and the output of the controller substantially reduces the output impedance of the controller thus providing a more effective electrification of long fences and of fences having relatively poor electrical insulation.

Referring now to FIGS. 2 and 3 of the accompanying drawings, the capacitor C14 of FIG. 1A is shown mounted above a printed circuit board 9, within a housing 12, the input supply to the electrical circuit of the controller being provided by a supply cable 6 the end of which is anchored by means of straps 7 beneath a terminal insulation cover 8.

Beneath the circuit board 9, which is provided with the electronic circuitry of FIG. 1A mounted thereon in known manner, the transformer windings of T1 and T2 and also the saturable inductor T3 are provided and are encapsulated within a suitable insulating material, such as epoxy resin, as required by regulations relating to such controllers. The output terminals 3 and 4 of the controller are provided on either side of the capacitor C14, which terminals extending downwardly through the base of the housing 12 and being provided with terminal connector members 13, to facilitate the connection of the fence circuit to the fence controller.

One of the output terminals would provide the live connection for the fence circuit while the other output terminal would provide the earth connection, in a known manner. The housing 12 would be suitably provided with an indication as to the connection from the fence circuit required to each of the terminals.

In FIG. 3 of the accompanying drawings, a cover 11 is shown mounted about the housing 12 and is secured thereover by means of bolts, screws or the like passing through apertures 14 provided in the housing, such that the electric circuitry within the controller is protected from the weather and any moisture entering therein while also providing a substantially dust proof and tamper resistant enclosure for the electrical circuitry of the controller as required by regulations, such as the New Zealand regulation hereinbefore mentioned.

It is envisaged that alternative solid state circuitry, including integrated circuit chips, transistors, F.E.T.'s and triacs, where suitable, could be used in the circuitry shown in FIG. 1A, instead of the diodes, thyristor and programmable unijunction transistor as shown.

Thus, the present invention provides an electric fence controller, which with an electrical circuit such as hereinbefore described, substantially reduces the output impedance of the circuit and which also provides a positive electric coupling between the controller circuit and the output terminals of the controller circuit.

Although this invention has been described by way of example and with reference to a preferred embodiment of the invention it is to be understood that modifications and improvements may be made thereto without departing from the scope of the invention as defined by the appended claims.

What we claim is:

1. An electric fence controller comprising:

a charging circuit including a ferro-resonant input transformer provided with a saturable core and a primary winding and a secondary winding wound on separate legs of said saturable core;

at least one capacitor connected across said secondary winding and forming a resonant circuit therewith;

an energy storing capacitive circuit connected to said charging circuit;

a voltage multiplying output circuit; and, a switching circuit connecting said capacitive circuit to said voltage multiplying output circuit;

said input transformer electrically isolating said output circuit from an input connected to said input transformer.

2. An electric fence controller as claimed in claim 1, wherein said core of said input transformer is a C-core.

3. An electric fence controller as claimed in claim 1, wherein said voltage multiplying output circuit comprises an auto transformer, controller output terminals connected across a winding of said auto transformer, and said capacitive circuit being connected by said switching circuit across part of said winding of said auto transformer.

4. An electric fence controller as claimed in claim 1, wherein said switching circuit comprises a solid state switching mechanism and a timing circuit connected with and controllig said solid state switching mechanism.

5. An electric fence controller as claimed in claim 4, wherein said input transformer is provided with a further winding and said switching mechansim includes a thyristor, and said timing circuit includes a transistor triggering circuit connected to and electrically supplied by said further winding provided on said input transformer.

6. An electric fence controller as claimed in claim 5, wherein said transistor triggering circuit includes a programmable uni-junction transistor.

7. An electric fence controller as claimed in claim 1, wherein said charging circuit includes a diode rectifier bridge connected across said capacitive circuit.

8. An electric fence controller as claimed in claim 1, further comprising a saturable inductor connected between said capacitive circuit and said output circuit and a spark gap circuit connected across said output circuit.

* * * * *